US007471885B2

(12) United States Patent
Mizukawa et al.

(10) Patent No.: US 7,471,885 B2
(45) Date of Patent: Dec. 30, 2008

(54) FILAMENT LAMP

(75) Inventors: Yoichi Mizukawa, Himeji (JP); Norihiro Inaoka, Himeji (JP); Tetsuya Kitagawa, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/565,089

(22) Filed: Nov. 30, 2006

(65) Prior Publication Data

US 2007/0120454 A1 May 31, 2007

(30) Foreign Application Priority Data

Nov. 30, 2005 (JP) ..... 2005-346337

(51) Int. Cl.
*F24C 7/00* (2006.01)

(52) U.S. Cl. ..... 392/407; 313/271

(58) Field of Classification Search ..... 392/407
See application file for complete search history.

(56) References Cited

U.S. PATENT DOCUMENTS

| | | | | |
|---|---|---|---|---|
| 2,159,794 | A | 5/1939 | Hagen et al. | |
| 3,039,015 | A * | 6/1962 | Jolly | 313/279 |
| 3,335,312 | A * | 8/1967 | Cardwell, Jr. | 313/279 |
| 4,359,665 | A * | 11/1982 | Morris et al. | 313/274 |
| 4,442,374 | A * | 4/1984 | Morris et al. | 313/316 |
| 4,580,079 | A * | 4/1986 | Koo | 315/65 |
| 4,605,877 | A * | 8/1986 | Cho et al. | 313/272 |
| 6,583,540 | B2 * | 6/2003 | Al-Refai | 313/316 |
| 6,624,428 | B2 | 9/2003 | Hishinuma | |
| 2004/0112885 | A1 | 6/2004 | Shigeoka et al. | |
| 2006/0197454 | A1 * | 9/2006 | Mizukawa et al. | 315/46 |
| 2006/0255736 | A1 * | 11/2006 | Selen et al. | 313/631 |
| 2007/0071906 | A1 * | 3/2007 | Seki et al. | 427/523 |

FOREIGN PATENT DOCUMENTS

| | | | |
|---|---|---|---|
| GB | 1 125 003 | A | 8/1968 |
| JP | 04329253 | A | 11/1992 |
| JP | 7037833 | A | 2/1995 |
| JP | 07016353 | U | 3/1995 |

* cited by examiner

*Primary Examiner*—Thor S Campbell
(74) *Attorney, Agent, or Firm*—David S. Safran; Roberts Mlotkowski Safran & Cole, P.C.

(57) ABSTRACT

A filament lamp in which the article to be treated can be uniformly heated, and in which the disadvantage of poor sealing or the like does not arise even in the case of inserting a host of metal foils into a hermetically sealed portion is achieved in a filament lamp in the bulb of which there are several filament bodies, in which filaments and leads for supply of power to the filaments are connected to one another, and in which, on an end of the bulb, there is a hermetically sealed portion in which there is a rod-shaped sealing insulator on the periphery of which several electrically conductive components that are connected to the filaments are arranged spaced from one another.

6 Claims, 7 Drawing Sheets

FILAMENT LAMP

BACKGROUND OF THE INVENTION

1. Field of the Invention

The invention relates to a filament lamp. The invention relates especially to a filament lamp for irradiation of an article to be treated with light which is emitted for purposes of heating of the article to be treated.

2. Description of Related Art

In semiconductor manufacturing, generally, heat treatment is used in different processes, such as a layer formation, oxidation-diffusion, diffusion of impurities, nitriding, layer stabilization, silicide formation, crystallization, ion implantation activation and the like.

To increase the yield and quality in semiconductor manufacture, rapid thermal processing RTP is desirable, in which the temperature of the article to be treated, such as a semiconductor wafer or the like, is rapidly raised or lowered. In RTP a heat treatment device of the light irradiation type (hereinafter also called only a heating device) using light irradiation from a light source, such as a filament lamp or the like, is widely used.

A filament lamp in which there is a filament within a bulb of transparent material is a typical lamp in which light can be used to produce heat since, in this connection, at least 90% of the input power is converted to heat and since heating is possible without contact with the article to be treated.

In the case of using this filament lamp as a heat source to heat a glass substrate and a semiconductor wafer, the temperature of the article to be treated can be raised/lowered more quickly than in a resistance heating process. This means that, by heat treatment of the light irradiation type, for example, the temperature of the article to be treated can be raised to at least 1000° C. in from ten to a few dozen seconds. After light irradiation has been stopped, the article to be treated is rapidly cooled. This heat treatment of the light irradiation type is normally done several times.

In this connection, if the article to be treated is, for example, a semiconductor wafer (silicon wafer), when a nonuniformity occurs as the semiconductor wafer is heated to at least 1050° C., a phenomenon called slip occurs in the semiconductor wafer, i.e., a defect of crystal transition, by which the danger arises that scrap will be formed. If RTP of a semiconductor wafer is carried out using a heat treatment device of the light irradiation type, heating must be performed, a high temperature maintained and then cooling must produced such that the temperature distribution of the overall surface of the semiconductor wafer becomes uniform. This means that, in RTP, there is a need for very precise temperature uniformity of the article to be treated.

In the case, for example, of a uniform physical property of the overall surface of the semiconductor wafer in heat treatment of the light irradiation type, the temperature of the semiconductor wafer does not become uniform even if light irradiation is performed such that the irradiance becomes uniform on the entire surface of the semiconductor wafer. In this connection, the temperature of the peripheral region of the semiconductor wafer is low. This is because in the peripheral region of the semiconductor wafer heat is radiated from the semiconductor wafer side. As a result of this heat release, a temperature distribution forms in the semiconductor wafer.

As was described above, in a semiconductor wafer slip occurs when a nonuniformity in the temperature distribution of the semiconductor wafer arises in the heating of the semiconductor wafer to at least 1050° C.

In order to make the temperature distribution of the semiconductor wafer uniform, it is therefore desirable to carry out light irradiation such that the irradiance on the surface of the peripheral area of the wafer is greater than the irradiance on the surface of the middle wafer area in order to equalize the temperature drop as a result of heat radiation from the side of the semiconductor wafer or the like.

Patent document 1 (JP HEI 7-37833 A) discloses a conventional heating device in which light emitted by a filament lamp is used to heat a glass substrate and a semiconductor wafer. This heating device has the arrangement shown in FIG. 6 in which in a chamber of transparent material there is the article to be treated and on a top step and a bottom step, therefore on two steps outside of this chamber there are several opposed filament lamps at top and bottom, and moreover, crossing one another, and in which the article to be treated is irradiated with light from both sides and heated.

FIG. 7 is a perspective in which the above described device is shown simplified and the filament lamps located on the top step and bottom step, therefore on the two steps, for heating and the article to be treated are shown. As shown in FIG. 7, the filament lamps for heating which are located on the top step and the bottom step, therefore on the two steps, are arranged such that the bulb axes cross. The article to be treated can therefore be heated uniformly. Furthermore, this device can prevent a temperature drop by the action of heat radiation in the peripheral area of the article to be treated. For example, with respect to the article to be treated, the lamp output of the filament lamps for heating L1, L2 located on the two sides of the top step is made larger than the lamp output of a lamp L3 for heating located in the middle area. The lamp output of the filament lamps for heating L4, L5 located on the two sides of the bottom step is made larger than the lamp output of a lamp L6 for heating located in the middle area. In this way, the amount of temperature drop by the action of heat radiation in the peripheral area of the article to be treated can be equalized, the temperature difference between the middle area and the peripheral area of the article to be treated can be reduced and the temperature distribution of the article to be treated can be made uniform.

In the above described conventional heating device it has however been found that the following disadvantages arise.

Specifically, for example, in the case in which the article to be treated is a semiconductor wafer, generally, a film of a metal oxide or the like is formed on the surface of the semiconductor by a sputtering process or the like, or foreign ion material is doped by ion implantation. The layer thickness of this metal oxide or the density of the foreign ions on the wafer surface has a local distribution which is not always centrosymmetric to the middle of the semiconductor wafer. For example, on the example of the density of foreign ions, there is a case according to FIG. 7 in which the density of foreign ions changes in a narrow, special region which is not centrosymmetric to the middle of the semiconductor wafer. Even if irradiation with light is performed such that, in this defined region and in the other region, the same irradiance is obtained, there is a case in which, between the rate of temperature rise in the above described defined region and the other region a difference forms. The temperature of the defined region described above does not always agree with the temperature of the other region.

The above described conventional heating device makes it possible to relatively easily equalize the effect of the temperature drop by heat radiation in the peripheral area of the region to be treated, to prevent a temperature drop in the peripheral area and to make the temperature distribution of the article to be treated uniform in a certain narrow region with a total length which is less than the emission length of the lamp, however, as is shown, for example, in FIG. 7, a region outside of the above described certain region is also irradiated with light, even if light irradiation is performed with an intensity which corresponds to the property of this certain region. Therefore, control cannot be exercised in such a manner that the above described certain region and the other region are shifted into suitable temperature state. This means that the irradiance in the above described, narrow defined region cannot be controlled such that the two temperatures become uniform. At the treatment temperature of the article to be treated, therefore, an unwanted temperature distribution occurs, resulting in the disadvantage that it becomes difficult after light heat treatment to impart the desired physical property to the article to be treated.

As is shown in FIG. 8, for example, in patent document 2 (JP 2002-203804 A and corresponding U.S. Patent Application Publication 2004/0112885 A1), a heat treatment device is disclosed in which there are a first lamp unit and a second lamp unit in the lamp housing. In the first lamp unit, several U-shaped double-end lamps in which there are feed devices for the filaments on the two ends of the bulb are arranged perpendicular and parallel to the page of the drawing. In the second lamp unit, several straight, double-end lamps which are located under the first lamp unit and in which on the two ends of the bulb there are feed devices for the filaments are located along the page of the drawings in the direction perpendicular to the page of the drawing. In this heat treatment device, an article, such as a semiconductor wafer or the like, which is located underneath the second lamp unit, is heat treated.

In this connection, it is shown that this heat treatment device yields a device which exercises control such that the U-shaped lamps of the first lamp unit which are located above the connecting part have a high output in order to increase the temperature of the connecting part on a support ring on which the article to be treated is placed, this connecting part having a tendency to have a lower temperature than the remaining region.

It is shown in patent document 2 that this heat treatment device is used essentially as follows.

First, the heating area of the semiconductor wafer as the article to be treated is divided into several zones which are centrosymmetric and concentric. By combining the distribution of the illuminance by the respective lamp of the first and second lamp units with one another, artificial illuminance distribution patterns are formed which correspond to the respective zone and which are centrosymmetric to the middle of the semiconductor. Thus, heating is carried out according to the temperature change of the respective zone. In this connection, the semiconductor wafer which constitutes the article to be treated is rotated to suppress the effect of the scattering of the illuminance of the lamp radiation. This means that the respective concentrically arranged zone can be heat treated at an individual illuminance.

Temperature control is possible by the technique described in patent document 2, therefore, in the case in which the narrow, defined region for the article to be treated is centrosymmetric to the middle of the semiconductor wafer. However, if the defined region is not centrosymmetric to the middle of the semiconductor wafer, the above described disadvantage cannot be advantageously eliminated because the semiconductor wafer which is the article to be treated is rotated.

Furthermore, in such a heat treatment device, it is possible for the following disadvantages to occur in practice. Specifically, a U-shaped lamp is formed of a horizontal region and a pair of vertical regions. However, since only the horizontal region in which the filament is located contributes to emission, the individual lamps are apart from one another over a space which cannot be ignored. Therefore, it can be imagined that a temperature distribution forms in the region which is located directly underneath this space.

Even if the distributions of the illuminance by the respective lamp of the first and second lamp units which corresponds to the respective zone are combined with one another and an artificial illuminance distribution is formed which is centrosymmetric to the semiconductor wafer, specifically the illuminance in the region directly underneath the above described space changes (decreases) relatively quickly. Therefore, it can be imagined that it is relatively difficult to reduce the temperature distribution which arises in the vicinity of the region which is located directly underneath the above described space, even if an attempt is made to carry out heating according to the temperature change of the respective zone.

Furthermore, such a heat treatment device is undesirable with respect to making the space smaller, since recently there has been a trend toward an extreme reduction in the size of the space (mainly vertically) for arrangement of the lamp units, and since therefore when a U-shaped lamp is used, a space corresponding to the vertical regions of the lamp is required.

FIG. 9 is a schematic perspective view of the basic arrangement of a filament lamp as disclosed in commonly-owned, co-pending U.S. patent application Ser. No. 11/362,788 (Patent Application Publication 2006/0197454 A1) relative to which one of the inventors of the present invention is a co-inventor and constitutes a precursor to the present invention. This filament lamp has several filaments in a bulb and separate control of emission and the like of the each filament is possible. By using a heat treatment device of the light irradiation type with light source parts in which these filament lamps are arranged parallel to one another, compared to the case of using a conventional filament lamp with a single filament in the bulb several filaments can be supplied individually. This makes it possible, even in the case of a shape of the defined region on the substrate-like article to be treated asymmetrical to the substrate shape, to irradiate this defined region with light of a certain light intensity. Therefore, it becomes possible, even in the case of an asymmetrical distribution of the degree of the local temperature distribution on the substrate-like article to be heat treated to the substrate shape, to uniformly heat the article to be treated. As a result, a uniform temperature distribution can be implemented over the entire article to be treated. When the heat treatment device of the light irradiation type using this type of bulb is compared, for example to the heat treatment device of the light irradiation type described in patent document 2, in which U-shaped lamps are used, in the heat treatment device of the light irradiation type of this co-pending application, it is possible to make the filaments lamps used in the form of a rod-shaped tube. The space corresponding to the vertical regions of the U-shaped lamp is therefore no longer necessary, and a reduction in size can be achieved.

The basic arrangement of the filament lamp shown in FIG. 9 is further described below. On the two ends of the bulb of this filament lamp, hermetically sealed portions are formed in which metal foils are inserted. In the bulb, there are several filament bodies (in FIG. 9, two bodies) which are formed of filaments and leads for feeding the filaments. In this connection, each filament body is arranged such that, in an arrangement of several filament bodies in the bulb, the filaments are arranged in rows in the lengthwise direction of the bulb.

There is an insulator, for example, of silica glass between the filaments which are arranged in rows in the lengthwise direction of the bulb. In FIG. 9, a lead which borders one end of a filament in one of the filament bodies passes through a through opening in the insulator. The outside of the point which is opposite the filament of the other filament body is covered with an insulating tube and is electrically connected to a metal foil which has been inserted in the hermetically sealed portion on one side of the end of the bulb. The lead which borders the other end of the filament in one of the filament bodies is electrically connected to a metal foil which is inserted in the hermetically sealed portion on the side of the other end of the bulb.

Likewise, one lead which borders one end of a filament in the other filament body passes through the through opening in the insulator. The outside of the point which is opposite the filament of the one filament body is covered with an insulating tube and is electrically connected to a metal foil which is inserted in the hermetically sealed portion on one side of the end of the bulb. The lead which borders the other end of the filament in the other filament body is electrically connected to a metal foil which has been inserted in the hermetically sealed portion on the side of the one end of the bulb.

An outer lead is connected to the end of the metal foil which is inserted in the hermetically sealed portion which is opposite the end to which the filament body is connected, such that the outer lead projects to the outside from the hermetically sealed portion. Two outer leads are therefore connected via the metal foil to the respective filament body. A feed device is connected to each filament via the outer leads. In this way, in the filament lamp, each filament of the respective filament body can be supplied individually.

The filament lamp shown in FIG. 9 had the following disadvantages.

The two ends of the filament lamp are hermetically terminated by a pinch seal. The pinch seal takes place, for example, by the outer leads being attached to the metal foils after welding of the outer leads and the leads of the filament body, the end of the bulb on which the metal foils are located being burned with a torch, and the metal foils being clamped from both sides by the metal shape which was produced in the form of the desired sealing area.

In the filament lamp which is shown in FIG. 9, in the hermetically sealed portion on the end of the tube, twice as many metal foils as the number of filaments are inserted in order to supply several filaments independently of one another. If an attempt is made to increase the number of filaments, therefore the number of metal foils inevitably increases. When a plurality of metal foils (for example, at least four) is required for the filament lamp shown in FIG. 9, it is necessary for the respective metal foil to have a certain cross sectional area to prevent fusing in the supply of the filaments. Moreover, it is necessary for the individual metal foils to be electrically insulated from the other metal foils. If an attempt is made to pinch a plurality of metal foils in a right-angled hermetically sealed portion, the region in which the metal foils are sealed is also made larger. For this reason, there were cases in which difficulties occurred in manufacture or poor sealing such as leaks and the like occurred more often. When poor sealing, such as a leak or the like occurs, air is mixed into the bulb of the filament lamp, resulting in the disadvantage of burning through by oxidation of the filaments. Likewise, the silica glass in the hermetically sealed portion is expanded by the metal foils being oxidized by the added air and expanding. Finally, the disadvantage of damage to the bulb occurs, by which the filament lamp becomes unusable. It can be imagined that a plurality of metal foils are necessary when it is necessary to control the local distribution with high precision in semiconductor heating.

The inventors conducted numerous studies to devise a filament lamp which has high reliability by its having a sealing arrangement in which these disadvantages, such as poor sealing and the like, do not occur, and thus they have completed the invention, as is described below.

SUMMARY OF THE INVENTION

A primary object of the invention is to devise a filament lamp in which the article to be treated can be uniformly heated and in which, moreover, it can be used for a heat treatment device of the light irradiation type which can be made smaller, even if the distribution of the degree of the local temperature change on the substrate-like article to be heat-treated is asymmetrical to the substrate shape, or also in the case in which the degree of the local temperature change differs in certain regions.

As is described below, the inventors have invented a filament lamp with a completely different arrangement than a conventional arrangement and a heat treatment device of the light irradiation type using this filament lamp. This heat treatment device of the light irradiation type makes it possible to overcome the above described disadvantages of the conventional heat treatment device of the light irradiation type.

A primary object of the invention lies especially in devising a filament lamp which acquires high reliability in that the disadvantage of poor sealing or the like does not arise for a filament lamp used for the above described heat treatment device of the light irradiation type even in the case of inserting a host of metal foils into a hermetically sealed portion.

The object is achieved in accordance with the invention in a filament lamp in which within the bulb several filament bodies, in which one filament and leads for supply of power to this filament are connected to one another, and in which on at least one end of the bulb there is a hermetically sealed portion in which there are several electrically conductive components which are each electrically connected to the several filament bodies, in that there is a rod-shaped insulator in the hermetically sealed portion for sealing, that moreover the several electrically conductive components are arranged spaced relative to one another in the outside periphery of the insulator for sealing, and that the bulb and the insulator are sealed at the hermetically sealed portion for sealing via the electrically conductive components.

The object is furthermore achieved in accordance with the invention in the above described filament lamp in that the above described electrically conductive components have at least metal foils which are electrically connected to the filament bodies, and have outer leads which are electrically connected to these metal foils, and that in the insulator for sealing, positioning openings for the above described outer leads are formed. In this connection, the "positioning openings" comprise openings and depressions which have a bottom.

The object is furthermore achieved in accordance with the invention in that a tapering area is formed on the end at least on one side of the respective filament body of the insulator for sealing.

The object is furthermore achieved in accordance with the invention in that the bulb has two opposite ends, each having a hermetically sealed portion and a rod-shaped sealing insulator located therein, with the several electrically conductive components being arranged spaced relative to one another in the outside peripheries of each of the insulators.

ACTION OF THE INVENTION

By the filament lamp in accordance with the invention, within the bulb, several filament bodies in which one filament and leads for supplying power to this filament are connected to one another, and on at least one end of the bulb there is a hermetically sealed portion in which several electrically conductive components are located, which are each electrically connected to one of the several filament bodies, in the hermetically sealed portion a rod-shaped insulator for sealing is located, moreover the several electrically conductive components are located in the outer periphery of the insulator at a distance from one another, and the bulb and the insulator for sealing are hermetically sealed via the electrically conductive components between the two. This arrangement enables a host of metal foils to be arranged on the same periphery at distances to one another. Furthermore, compared to the arrangement of a host of metal foils in a right-angled hermetically sealed portion, as in the filament lamp shown in FIG. 9, the size of the hermetically sealed portion can be reduced, by which the disadvantage of poor sealing or the like never occurs and by which a filament lamp with high reliability can be devised.

Furthermore, by forming the positioning openings of the outer leads in the insulator for sealing, the positions of the outer leads can be positioned at defined positions.

Moreover, by forming the tapering regions on the end at least on the side of the filament bodies of the insulator for sealing on the end of the hermetically sealed portion in which the bulb and the insulator for sealing are hermetically sealed on one another via the electrically conductive components, the thickness of the silica glass comprising the bulb and insulator for sealing can be increased. In this way the reliability of sealing can be increased.

The following effects can be obtained by the heat treatment device of the light irradiation type in accordance with the invention.

As was described above, in the heat treatment device of the light irradiation type in accordance with the invention, the lamp units as light source parts are arranged by a parallel arrangement of several filament lamps which were described above, by which setting of the intensity distribution of the light emitted from the light source parts of the filament lamps can also be controlled in the axial direction of the bulb, while setting the intensity distribution of the light emitted from the light source part of the conventional filament lamp with a single filament in the bulb could only be controlled in the direction perpendicular to the axial direction of the bulb.

Setting the distribution of the irradiance on the surface of the article to be treated in the two-dimensional direction with high precision is therefore enabled.

Therefore, it becomes possible, for example, even in a narrow defined region of smaller overall length than the emission length of the filament lamp which was used for the light source part of the conventional heat treatment device of the light irradiation type, with limitation to this defined region to set the irradiance on this defined region. Furthermore, it also becomes possible to set the distribution of the irradiance on the article to be treated asymmetrically to the shape of the article to be treated. This means that it becomes possible to precisely set the distribution of the irradiance on the article to be treated which is at given distance apart from the lamp units to any distribution.

Thus, it becomes possible to exercise control such that the temperature of the above described defined region and other region become uniform, or it becomes possible to set the distribution of the illuminance on the article to be treated and for example to carry out uniform heating of the article to be treated according to the case in which the distribution of the degree of the local temperature change on the substrate which is to be heat treated and which constitutes the article to be treated is asymmetrical to the substrate shape.

Since compared to the conventional example in which U-shaped lamps are used, in the heat treatment device of the light irradiation type in accordance with the invention, filament lamps are used in which the distance between the respective filaments to be arranged in the bulb can be reduced to an extreme degree, the effect of the distance between the filaments which is a not an emitting space can be reduced to a minimum, by which it becomes possible to make unwanted scattering of the distribution of the illuminance on the article to be treated extremely small. Since, in the vertical direction of the heating device, there is no vertical part of the lamp, the space corresponding to this within the lamp unit is no longer required, by which the heating device can be made smaller.

The invention is explained in detail below using several embodiments shown in the drawings.

BRIEF DESCRIPTION OF THE DRAWINGS

FIG. 1(*b*) is a sectional view taken along line A-A' in FIG. 1(*a*);

DETAILED DESCRIPTION OF THE INVENTION (A. Arrangement of a Filament Lamp)

Figures 1A, 1B:
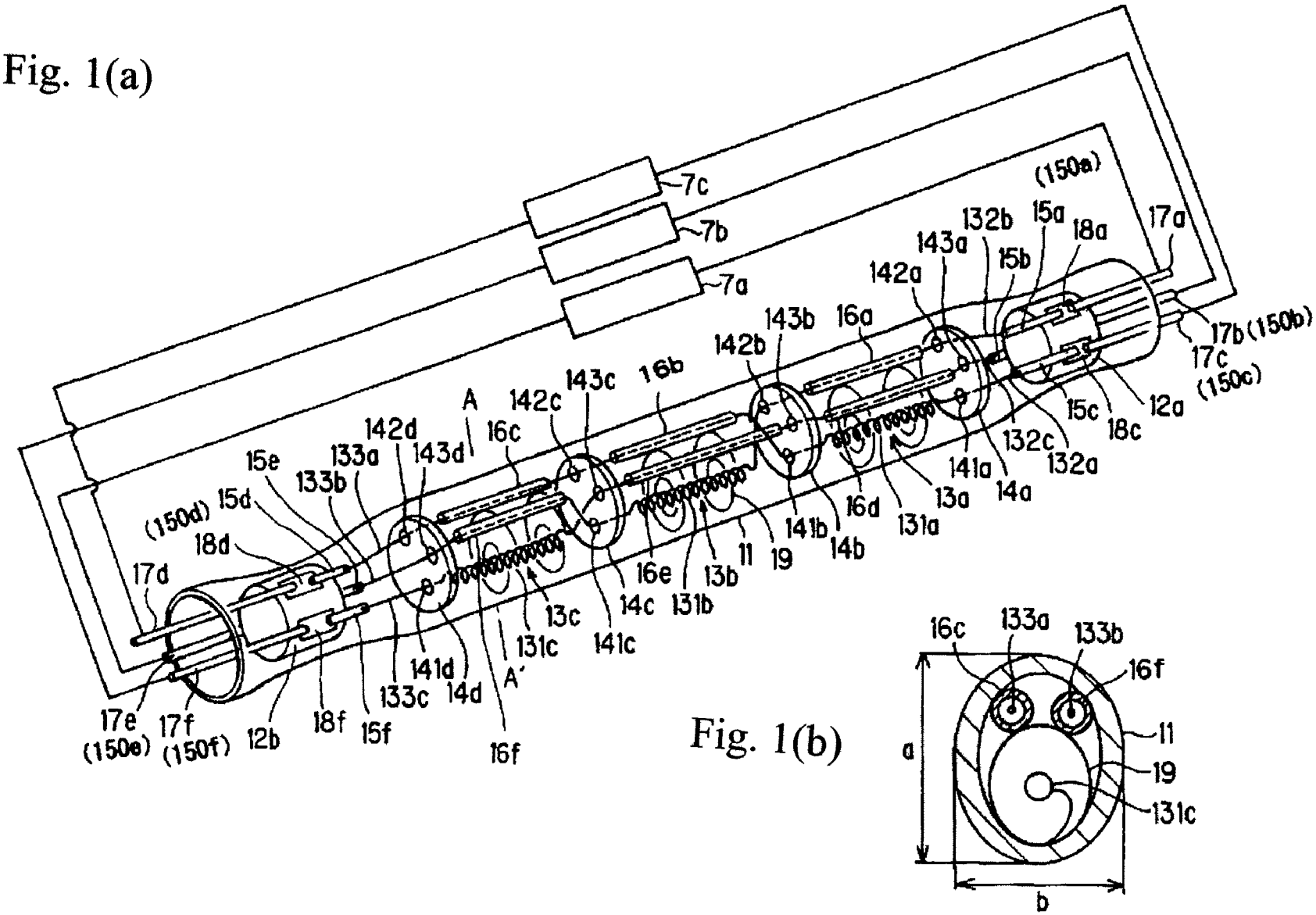
FIG. 1(*a*) is a schematic perspective view of one embodiment of a filament lamp in accordance with the invention &
Figure 2A:
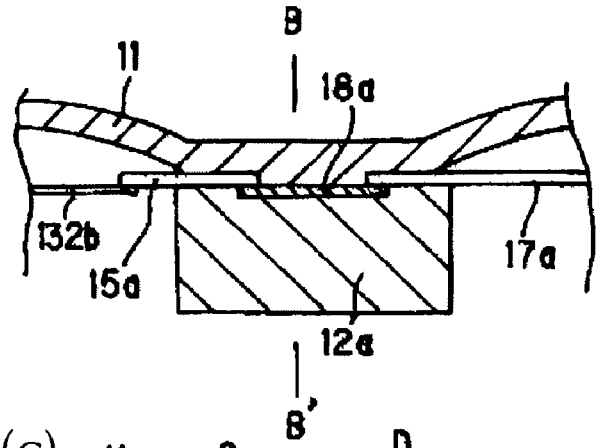
FIGS. 2(*a*) to 2(*g*) each show an enlarged cross section of the vicinity of the insulator for sealing in accordance with the invention, FIGS. 2(*a*), (*c*), (*f*), & (*g*) being partial longitudinal sections and FIGS. 2(*b*), (*d*) and (*e*) being transverse sectional views.
Figure 2B:
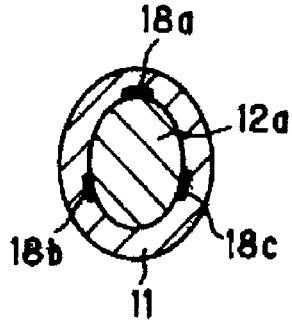
Figure 2C:
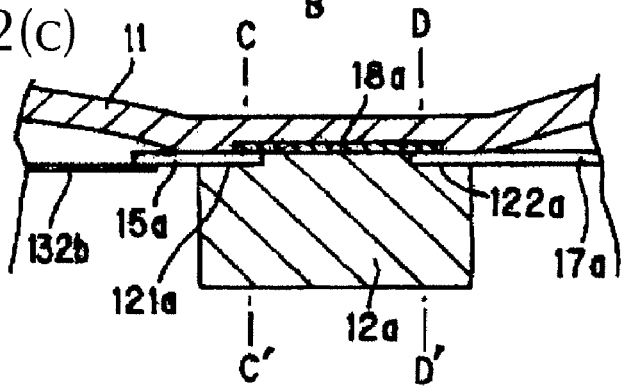
Figure 2D:
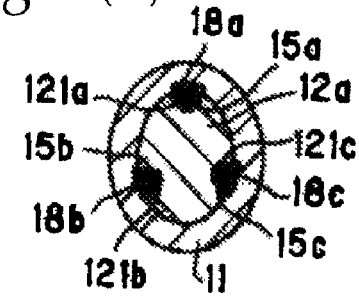
Figure 2F:
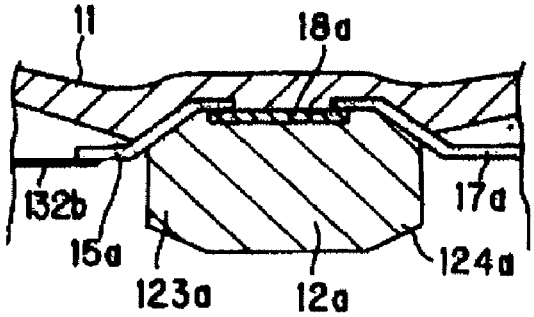
Figure 2E:
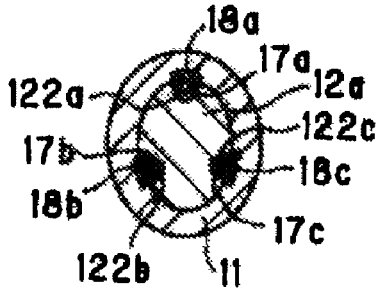
Figure 2G:
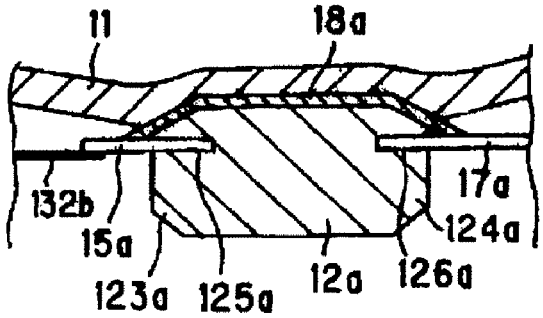

FIGS. 1(*a*) & 1(*b*) show an embodiment of a filament lamp in accordance with the invention which is comprised of bulb 11 made of a transparent material such as, for example, silica glass or the like. As can be seen from transverse cross-sectional view of FIG. 1(*b*), the bulb has an oblong cross-sectional shape, but a circular shape can also be used. The term "oblong" is to be understood as encompassing all shapes in which the length a in the lengthwise direction is greater than the length b in the direction perpendicular to the lengthwise direction the cross-sectional shape, as is shown in FIG. 1(*b*). By using an oblong shape, the above described filament bodies and insulating tubes can be easily arranged in the direction shown in FIG. 1. The bulb 11 is filled with a halogen gas, and furthermore, there are three filament bodies 13*a*, 13*b*, and 13*c* in it. On the inside in the vicinity of the two ends, there are rod-shaped insulators 12*a*, 12*b* for sealing.

Electrically conductive components 150*a*, 150*b*, 150*c* are each electrically connected to the filament bodies 13*a*, 13*b*, 13*c* to at one end of the lamp, while electrically conductive components 150*d*, 150*e*, 150*f* are electrically connected to at the other end.

In the filament lamp shown in FIGS. 1(*a*) & 1(*b*), the electrically conductive component 150*a* is formed of an inner lead 15*a* which is electrically connected to a lead 132*b* described below, of a metal foil 18*a* which is electrically connected to the inner lead 15*a*, and of an outer lead 17*a* which is electrically connected to the metal foil 18*a*. The other electrically conductive components 150*b* & 150*f*, like 150*a*, each are comprised of an inner lead, a metal foil and an outer lead. There are inner leads 15*a*, 15*f*, for reasons such as simple processing in lamp production, limitation of the processing procedure, and for similar reasons. However, in the case in which handling in production and processing, such as in welding or the like, is simple, if the rated wattage of the filament should be small and the litz wire diameter of the line should be relatively small or in similar cases, the lead 132*b* can be directly connected to the metal foil 18*a* without using the inner lead. That is, the above described electrically conductive component 150*a* can also be comprised of a metal foil 18*a* which is electrically connected to the lead 132*b* and of an outer lead 17*a* which is electrically connected to the metal foil 18*a*. The same as for 150*a*, also applies to the other electrically conductive components 150*b*, 150*f*.

The electrically conductive components of the filament lamp in accordance with the invention have both the function of supply of the filament bodies by presence between the two, i.e., the filament bodies and the feed device described below, and by the electrical leads to the two, as well as the function of the hermetic sealing described below by presence between the two, i.e., the bulbs and the insulators for sealing. In the filament lamp shown in FIGS. 1(*a*) & 1(*b*), as is described below using one example, the bulb and the insulators for sealing are hermetically sealed to one another via the metal foils. However, the electrically conductive components need not always be formed of inner leads, metal foils and outer leads, i.e., of three parts, but, for example, an electrically conductive component can be used in which the inner lead, as was described above, is omitted, and in which the lead of a filament body described below and the metal foil are electrically connected to one another. Furthermore, an arrangement can be undertaken in which a rod-shaped body or a metal foil which is routed out of the bulb is connected to the respective filament body, and in which part of this rod-shaped body or the metal foil is sealed.

In the insulator 12*a* of the three electrically conductive components 150*a*, 150*b*, 150*c*, the metal foils 18*a*, 18*b*, 18*c* are arranged parallel to one another essentially at the same distance on the peripheral surface along the lengthwise direction of the insulator 12*a*. The metal foil 18*a* is connected to the inner lead 15*a* and the outer lead 17*a*. The metal foil 18*b* is connected to the inner lead 15*b* and the outer lead 17*b*. The metal foil 8*c* is connected to the inner lead 15*c* and the outer lead 17*c*.

In the insulator 12*b* of the three electrically conductive components 150*d*, 150*e*, and 15*f*, the metal foils 18*d*, 18*e*, 18*f* are arranged parallel to one another essentially with the same distance on the peripheral surface along the lengthwise direction of the insulator 12*b*. The metal foil 18*d* is connected to the inner lead 15*d* and the outer lead 17*d*. The metal foil 18*e* is connected to the inner lead 15*e* and the outer lead 17*e*. The metal foil 18*f* is connected to the inner lead 15*f* and the outer lead 17*f*.

The filament body 13*a* is formed of a filament 131*a*, a lead 132*a* which is connected to one end of the filament 131*a*, and a lead 133*a* which is connected to the other end of the filament 131*a*. The filament body 13*b* is formed of a filament 131*b*, a lead 132*b* and a lead 133*b*. The filament body 13*c* is formed of a filament 131*c*, a lead 132*c* and a lead 133*c*. The filaments 131*a*, 131*b* and 131*c* are preferably coaxially arranged, but they need not be coaxially arranged; however, in the case in which the positional deviation of the filaments from one another can be equalized by simultaneous use of optical elements, such as a reflector and the like, when the distance between the article to be treated and the lamp is relatively large, when the position deviation of the filaments from one another compared to the distance between the article to be treated and the lamp is relatively small, and therefore the distribution of the illuminance is not affected, or in similar cases.

The filaments 131*a*, 131*b* and 131*c* are supported without contact with the bulb 11 by a spiral anchor 19 which is clamped between the inside wall of the bulb 11 and the insulating tube 18. In this connection, in the emission of the filaments, if the filament 131 and the inside wall of the bulb 11 come into contact with one another, the transparency of the bulb 11 in the contact area is damaged by the heat of the filament 131. The anchor 19 is used to prevent this problem from occurring. There are several anchors 19 with regard to the respective filament in the lengthwise direction of the bulb. The anchor also has a certain elasticity so that in the production of the filament lamp several filament bodies are easily inserted into the bulb.

Between the insulator 12*a* and the filament 131*a*, between the filaments 131*a*, 131*b*, between the filaments 131*b*, 131*c*, and between the filament 131*c* and the insulator 12*b*, there are separating boards 14*a*, 14*b*, 14*c*, 14*d* made of silica glass. The insulators 14*a*, 14*b*, 14*c*, 14*d* are used to prevent contacts with the filament bodies 13*a*, 13*b* 13*c* and each have three through openings.

The lead 132*a* for the filament body 13*a* is inserted into a through opening 141*a* in the separating board 14*a* and is connected to the inner lead 15*c* in the insulator 12*a*. The lead 133*a* in the filament body 13*a* is inserted into the through opening 141*b* in the separating board 14*b*, an insulating tube 16*b* which is located opposite the filament 131*b* is inserted into a through opening 142*c* located in the separating board 14*c*, an insulating tube 16*c* which is located opposite the filament 131*c* is inserted into a through opening 142*d* located in the separating board 14*d* and is connected to the inner lead 15*d* located in the insulator 12*b*.

The lead 132*b* in the filament body 13*b* is inserted into the through opening 142*b* located in the separating board 14*b*, into an insulating tube 16*a* which is located opposite the filament 131*a*, and into a through opening 142*a* which is located in the separating board 14*a*, and is connected to the inner lead 15*a* located in the insulator 12*a*. The lead 133*b* in the filament body 13*b* is inserted into the through opening 141*c* located in the separating board 14*c*, into an insulating tube 16*f* which is located opposite the filament 131*c*, and into a through opening 143*d* located in the separating board 14*d*, and is connected to the inner lead 15*e* located in the insulator 12*b*.

The lead 132*c* in the filament body 13*c* is inserted into the through opening 143*c* located in the separating board 14*c*, into the insulating tube 16*e* which is located opposite the filament 131*b*, into a through opening 143*b* which is located in the separating board 14*b*, into an insulating tube 16*d* which is located opposite the filament 131*a*, and into a through opening 143*a* located in the separating board 14*a*, and is connected to the inner lead 15*b* located in the insulator 12*a*. The lead 133*c* for the filament body 13*c* is inserted into the through opening 141*d* located in the separating board 14*d* and is connected to the inner lead 151 located in the insulator 12*b*.

FIGS. 2(*a*) to 2(*g*) are each an enlarged cross-sectional view of the vicinity of the insulator 12*a*. FIG. 2(*a*) is an enlarged cross section of important parts of a filament lamp in the lengthwise direction in order to show a first example of the sealing arrangement. FIG. 2(*b*) is a transverse cross section through a section along the line B-B' of FIG. 2(*a*). FIG. 2(*c*) & FIG. 2(*e*) each schematically show a second example of the sealing arrangement. FIG. 2(*c*) is an enlarged cross section of important parts of a filament lamp in the lengthwise direction. FIGS. 2(*d*) & 2(*e*) are transverse cross sections taken alone the line C-C' and line D-D', respectively, in FIG. 2(*c*). FIGS. 2(*f*) & 2(*g*) are enlarged cross sections of important parts of the filament lamp in the lengthwise direction showing third and fourth examples of the sealing arrangement. The insulator for sealing is formed of an insulating material, such as, for example, silica glass or the like.

As is shown in FIG. 2(*a*), in the outer periphery of the insulator 12*a*, there is a metal foil 18*a* that extends essentially parallel along the lengthwise direction of the insulator 12*a*. The metal foil 18*a* is connected to the inner lead 15*a* and to the outer lead 17*a* and has a smaller total length than the insulator 12*a*.

By this measure the inner lead 15*a*, the outer lead 17*a* and the metal foil 18*a* can be completely sealed without the metal foil 18*a* being exposed to the outside world. The disadvantage of no longer possible operation of the filament lamp by tearing of the thin metal foil 18*a* with a small thickness of roughly 30 microns due to inattentiveness or the like during operation therefore never occurs.

In the insulator 12*a*, although not shown in FIG. 2(*a*), the inner lead 15*b*, the metal foil 18*b*, the outer lead 17*b*, the inner lead 15*c*, the metal foil 18*c*, and the outer lead 17*c* as shown in FIG. 1(*a*) are arranged in the same way as the inner lead 15*a*, the metal foil 18*a* and the outer lead 17*a*. The inner lead 15*b*, the metal foil 18*b*, the outer lead 17*b*, the inner lead 15*c*, the metal foil 18*c* and the outer lead 17*c* have the same shapes and the same total lengths as the inner lead 15*a*, the metal foil 18*a*, and the outer lead 17*a*. The insulator 12*b* has the same arrangement as the insulator 12*a*.

The bulb 11 and the insulator 12*a* are hermetically sealed via the metal foils 18*a*, 18*b*, 18*c* by heating the outer periphery of the bulb 11 which corresponds to the location at which the insulator 12*a* is located with a torch or the like, as is shown in FIG. 2(*b*). The outside diameter of the insulator 12*a* is smaller than the inside diameter of the bulb 11. The bulb 11 is therefore reduced in diameter in the region which is present tightly directly adjoining the insulator 12*a*, specifically in the hermetically sealed portion.

In the second example of the sealing arrangement, in the depressions 121*a*, 121*b*, 121*c* which are provided in a cylindrical insulator 12*a*, there are inner leads 15*a*, 15*b*, 15*c*, as is shown in FIGS. 2(*c*) & 2(*d*). Furthermore, as is shown in FIGS. 2(*c*) & 2(*e*), in the depressions 122*a*, 122*b*, 122*c* which are provided in the insulator 12*a*, there are outer leads 17*a*, 17*b*, 17*c*. The inner lead 15*a* and the outer lead 17*a* are electrically connected to the two ends of the metal foil 18*a*. The inner lead 15*b* and the outer lead 17*b* are electrically connected to the two ends of the metal foil 18*b*. The inner lead 15*c* and the outer lead 17*c* are electrically connected to the two ends of the metal foil 18*c*. The total length of the metal foils 18*a*, 18*b*, 18*c* is less than the insulator 12*a*. The insulator 12*b* has the same arrangement as the insulator 12*a*.

This measure yields the advantage that the depressions 121*a*, 121*b*, 121*c* determine the positions of the inner leads 15*a*, 15*b*, 15*c*, and the depressions 122*a*, 122*b*, 122*c* determine the positions of the outer leads 17*a*, 17*b*, 17*c*. Furthermore, in the insulator 12*a*, the depressions (in the insulator 12*a*) 121*a*, 121*b*, 121*c* for the arrangement of the inner leads 15*a*, 15*b*, 15*c* can also be omitted. In the insulator 12*b*, likewise, the depressions for the arrangement of the inner leads 15*d*, 15*e*, 15*f* can also be omitted.

In the third example of the sealing arrangement, as is shown in FIG. 2(*f*), an insulator 12*a* is used, with two ends provided with tapering regions 123*a* and 124*a*. The inner lead 15*a* and the outer lead 17*a* have shapes which are bent according to the shape of the tapering region of the insulator 12*a*. This inner lead 15*a* and this outer lead 17*a* are located along the tapering regions 123*a*, 124*a* of the insulator 12*a*. The inner lead 15*a* and outer lead 17*a* are connected to the two ends of the metal foil 18*a* which is located on the outer peripheral surface of the insulator 12*a*. The total length of the metal foil 18*a* is less than the insulator 12*a*.

The reason for placing the tapering regions on the two ends of the insulator 12*a* is that the thickness of the bulb on the ends of the sealing area is made large and that therefore the reliability of sealing can be increased. Furthermore, there can be a tapering region for the insulator 12*a* on only one side of the filament body (to the left in the drawings) with a higher pressure.

In the insulator 12*a*, the inner lead 15*b*, the metal foil 18*b*, the outer lead 17*b*, the inner lead 15*c*, the metal foil 18*c*, and the outer lead 17*c* as shown in FIG. 1(*a*) are arranged in the same way as the inner lead 15*a*, the metal foil 18*a* and the outer lead 17*a*. The insulator 12*b* has the same arrangement as the insulator 12*a*.

In the fourth example of the sealing arrangement, as is shown in FIG. 2(*g*), the ends of the insulator 12*a* are provided with tapering regions 123*a*, 124*a*, and the metal foil 18*a* has a greater total length than the insulator 12*a*.

In the insulator 12*a*, the inner lead 15*a* is inserted into an opening 125*a* (blind hole) which has a bottom and is attached; the opening is formed on the surface on the end of the filament body, and the outer lead 17*a* is inserted into a blind hole 126*a* and attached; the blind hole is formed on the outer side of the bulb. By this measure, the position of the inner lead 15*a* is determined by the depth of the blind hole 125*a*, and the position of the outer lead 17*a* is determined by the depth of the blind hole 126*a*.

In the insulator 12*a*, the inner lead 15*b*, the metal foil 18*b*, the outer lead 17*b*, the inner lead 15*c*, the metal foil 18*c*, and the outer lead 17*c*, as shown in FIG. 1(*a*), are arranged in the same way as the inner lead 15*a*, the metal foil 18*a* and the outer lead 17*a*. The insulator 12*b* has the same arrangement as the insulator 12*a*.

For the filament lamp 1, feed devices 7*a*, 7*b*, 7*c* are connected to the outer leads 17*a*, 17*b*, 17*c*, 17*d*, 17*e* and 17*f* which project from the two ends of the bulb 11 to the outside such that the filament bodies 13*a*, 13, 13*c* can each be supplied with power. Specifically, the feed device 7*a* is connected between the outer leads 17*a*, 17*e*, the feed device 7*b* is connected between the outer leads 17*b*, 17*f* and the feed device 7*c* is connected between the outer leads 17*c*, 17*d*, as is shown in FIG. 1(*a*).

In the example shown in FIG. 1(*a*), an arrangement is shown in which there are three filament bodies in the bulb. However, the number of filament bodies can be increased or reduced as necessary. In particular, when there are a plurality of filament bodies, the arrangement of the invention is effective because there can be a plurality of metal foils along the peripheral surface of the insulator.

Figure 3:
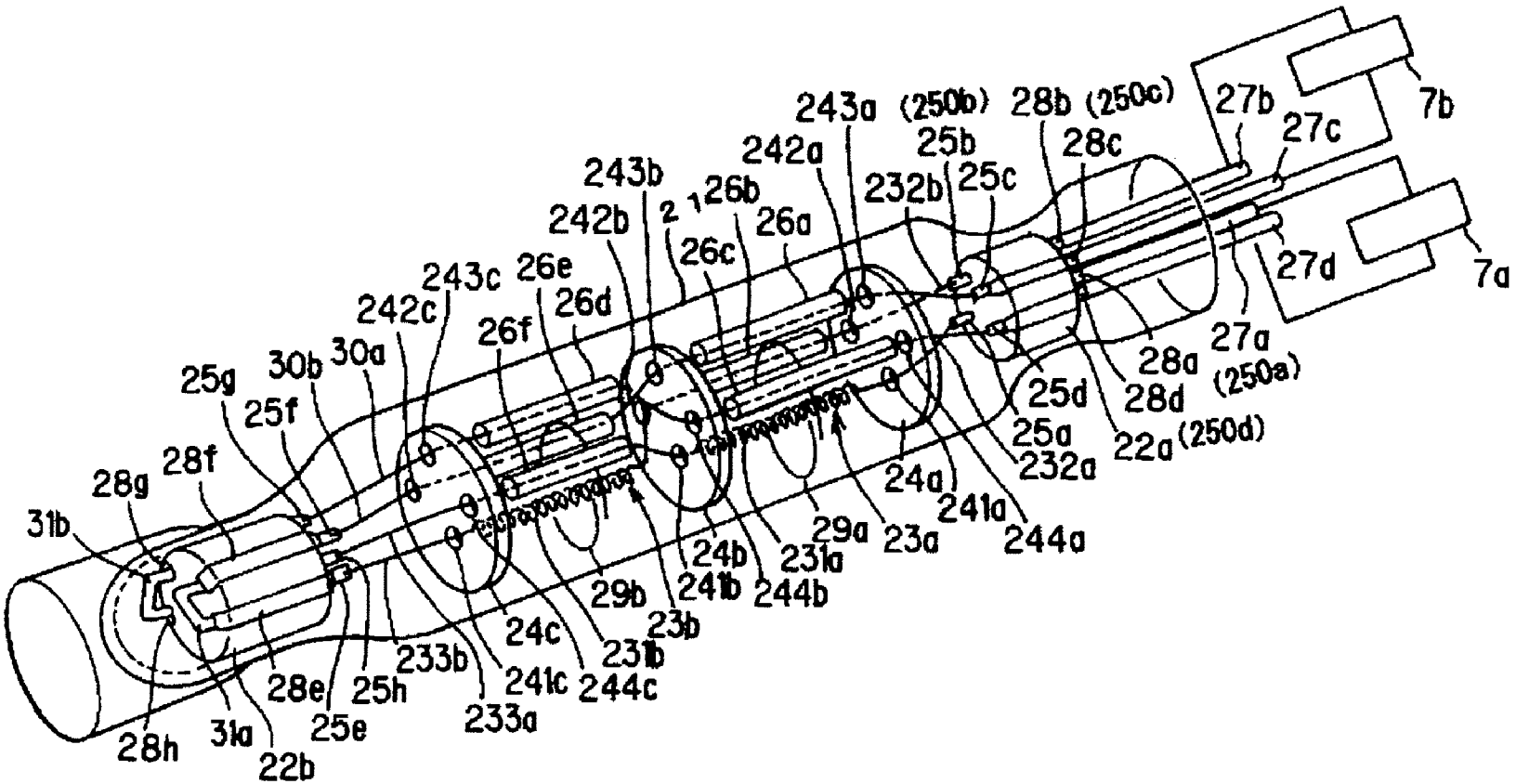
FIG. 3 is a view similar to that of FIG. 1(*a*), but showing another embodiment of a filament lamp in accordance with the invention.

FIG. 3 is a schematic of another embodiment of the filament lamp in accordance with the invention. The specific arrangement is described below. However, it differs from the filament lamp shown in FIGS. 1(*a*) and (*b*) in that the outer lead projects out of only one end of the bulb.

In the bulb 21 of the FIG. 3 filament lamp, there are two filament bodies 23*a*, 23*b*, feed lines 30*a*, 30*b* which are each electrically connected to the filament bodies, insulators 24*a*, 24*b*, 24*c*, insulating tubes 26*a*, 26*b*, 26*c*, 26*d*, 26*e*, 26*f* and anchors 29*a*, 29*b*. Furthermore, in the vicinity of the two ends of the bulb 21, there are sealing insulators 22*a*, 22*b*. At the locations at which there are insulators 22*a*, 22*b*, hermetically sealed portions are formed in which the bulb 21 is hermetically sealed on the insulators 22*a*, 22*b* via metal foils which are located in the outer periphery of the insulators 22*a*, 22*b*.

In the filament lamp shown in FIG. 3, electrically conductive components 250*a*, 250*b*, 250*c*, 250*d* are each electrically connected to the filament bodies 23*a*, 23*b*. The electrically conductive component 250*a* is formed of an inner lead 25*a* which is electrically connected to one end of the filament body 23*a* (lead 232*a*), of a metal foil 28*a* which is electrically connected to the inner lead 25*a*, and of an outer lead 27*a* which is electrically connected to the metal foil 28*b*.

The electrically conductive component 250*c* is formed of an inner lead 25*b* which is connected to the end of the filament body 23*b* (lead 232*b*), of a metal foil 28*b* which is electrically connected to the inner lead 25*b*, and of an outer lead 27*b* which is electrically connected to the metal foil 28*b*.

The electrically conductive component 250*c* is formed of an inner lead 25*c* which is connected to the feed line 30*b*, of a metal foil 28*c* which is electrically connected to the inner lead 25*c*, and of an outer lead 27*c* which is electrically connected to the metal foil 28*c*.

The electrically conductive component 250*d* is formed of an inner lead 25*d* which is connected to the feed line 30*a*, of a metal foil 28*d* which is electrically connected to the inner lead 25*d*, and of an outer lead 27*d* which is electrically connected to the metal foil 28*d*.

In the filament lamp shown in FIG. 3, as in the filament lamp shown in FIGS. 1(*a*) & 1(*b*), the electrically conductive components need not always be comprised of inner leads, metal foils and outer leads, i.e., of three parts, but can also be comprised of two parts, i.e., metal foils and outer leads.

In the sealing insulator 22*a*, the inner leads 25*a*, 25*b*, 25*c*, 25*d* are inserted into four blind holes and attached; these blind holes are provided on the face sides on the side of the filament body, and the outer leads 27*a*, 27*b*, 27*c*, 27*d* are inserted into and attached in four blind hoes; theses holes are provided on the end face on the outer side of the bulb. On the outer periphery of the insulator 12*a*, there are four metal foils 28*a*, 28*b*, 28*c*, 28*d* arranged essentially at the same distance relative to one another along the lengthwise direction of the insulator 12*a*. The metal foil 28*a* is connected to the inner lead 25*a* and outer lead 27*a*, the metal foil 28*b* is connected to the inner lead 25*b* and outer lead 27*b*, the metal foil 28*c* is connected to the inner lead 25*c* and outer lead 27*c* and the metal foil 28*d* is connected to the inner lead 25*d* and outer lead 27*d*.

In the insulator 22*b*, the inner leads 25*e*, 25*f*, 25*g*, 25*h* are inserted into four holes and attached; these holes are provided on the end face on the side of the filament body and electrically conductive coupled components 31*a*, 31*b* are attached in holes which are located on the face on the outer side of the bulb. By connecting the metal foils 28*e*, 28*f* to the electrically conductive coupled component 31*a* the inner leads 25*e*, 25*f* are electrically connected. By connecting the metal foils 28*g*, 28*h* to the electrically conductive coupled component 31*b* the inner leads 25*g*, 25*h* are electrically connected.

The filament body 23*a* formed of a filament 231*a*, a lead 232*a* which is connected to one end of the filament 231*a*, and a lead 233*a* which is connected to the other end of the filament 231*a*. The filament body 23*b* like the filament body 23*a* formed of a filament 231*b*, a lead 232*b* and a lead 233*b*. The filaments 231*a* and 231*b* are preferably coaxially arranged. However, they need not be coaxially arranged in the case in which the position deviation of the filaments from one another can be equalized by simultaneous use of optical elements, such as a reflector and the like, when the distance between the article to be treated and the lamp is relatively large, when the position deviation of the filaments from one another compared to the distance between the article to be treated and the lamp is small, and when therefore the distribution of the illuminance is not affected, and in similar cases.

The insulators 24*a*, 24*b*, and 24*c* are each provided with four through openings for passage of the leads 232*a*, 233*a*, 232*b* and 233*b* for the respective filament body and the feed lines 30*a*, 30*b*. The insulator 24*a* is located between the filament 231*a* and the insulator 22*a* for sealing. The insulator 24*b* is located between the filament 231*a* and filament 231*b*. The insulator 24*c* is located between the filament 231*b* and the insulator 22*b*.

The lead 232*a* for the filament body 23*a* is inserted into a through opening 241*a* which is provided in the insulator 24*a*, and connected to the inner lead 25*a* which is inserted and attached in the insulator 12*a*. The lead 233*a* for the filament body 23*a* is inserted into a through opening 241*b* which is provided in the insulator 24*b*, into the insulating tube 26*f* which is located opposite the filament 231*b*, and into the through opening 244*c* provided in the insulator 24*c* and is connected to the inner lead 25*h* which is inserted and attached in the insulator 12*b*.

One end of the feed line 30*a* is connected to the inner lead 25*g* which is attached in the insulator 12*b*. Its other end is inserted into a through opening 243*c* which is provided in the insulator 24*c*, into the insulating tube 26*d* which is located opposite the filament 231*b*, into the through opening 244*b* provided in the insulator 24*b*, into the insulating tube 26*c* which is located opposite the filament 231*a*, into a through opening 244*a* which is provided in the insulator 24*a* in this sequence, and is attached in the inner lead 25*d* which is attached in the insulator 12*a*. The filament body 23*a* and the feed line 30*a* are electrically connected to one another by the electrical lead of the inner leads 25*g*, 25*h*.

The lead 232*b* for the filament body 23*b* is inserted into a through opening 242*b* which is provided in the insulator 24*b*, into the insulating tube 26*c* which is located opposite the filament 231*a*, into a through opening 242*a* which is provided in the insulator 24*a* in this sequence, and is connected to the inner lead 25*b* which is inserted in the insulator 12*a* and attached. The lead 233*b* in the filament body 23*b* is inserted into a through opening 241*c* which is provided in the insulator 24*c*, and is connected to the inner lead 25*e* which is inserted into the insulator 12*b* and attached.

One end of the feed line 30*b* is connected to the inner lead 25*f* which is inserted into the insulator 22*b* and attached, into the through opening 242*c* which is provided in the insulator 24*c*, into the insulating tube 26*e* which is located opposite the filament 231*b*, into the through opening 243*b* provided in the insulator 24*b*, into the insulating tube 26*a* which is located opposite the filament 231*a*, into a through opening 243*a* which is provided in the insulator 24*a* in this sequence and is connected to the inner lead 25*c* which is inserted and attached in the insulator 22*a* for sealing.

The filament body 23*b* and the feed line 30*b* are electrically connected to one another by the electrical connection of the inner leads 25 and 25*f* to one another.

For the filament lamp 2 feed devices 7*a*, 7*b* are connected to the outer leads 27*a*, 27*b*, 27*c*, 27*d* which project from one end of the bulb 11 to the outside, such that the filament bodies 23*a*, 23*b*, can each be supplied. Specifically, the feed device 7*a* is connected between the outer leads 27*a*, 27*d* and the feed device 7*b* is connected between the outer leads 27*b*, 27*c*.

(B. Arrangement of the Heating Device)

Figure 4:
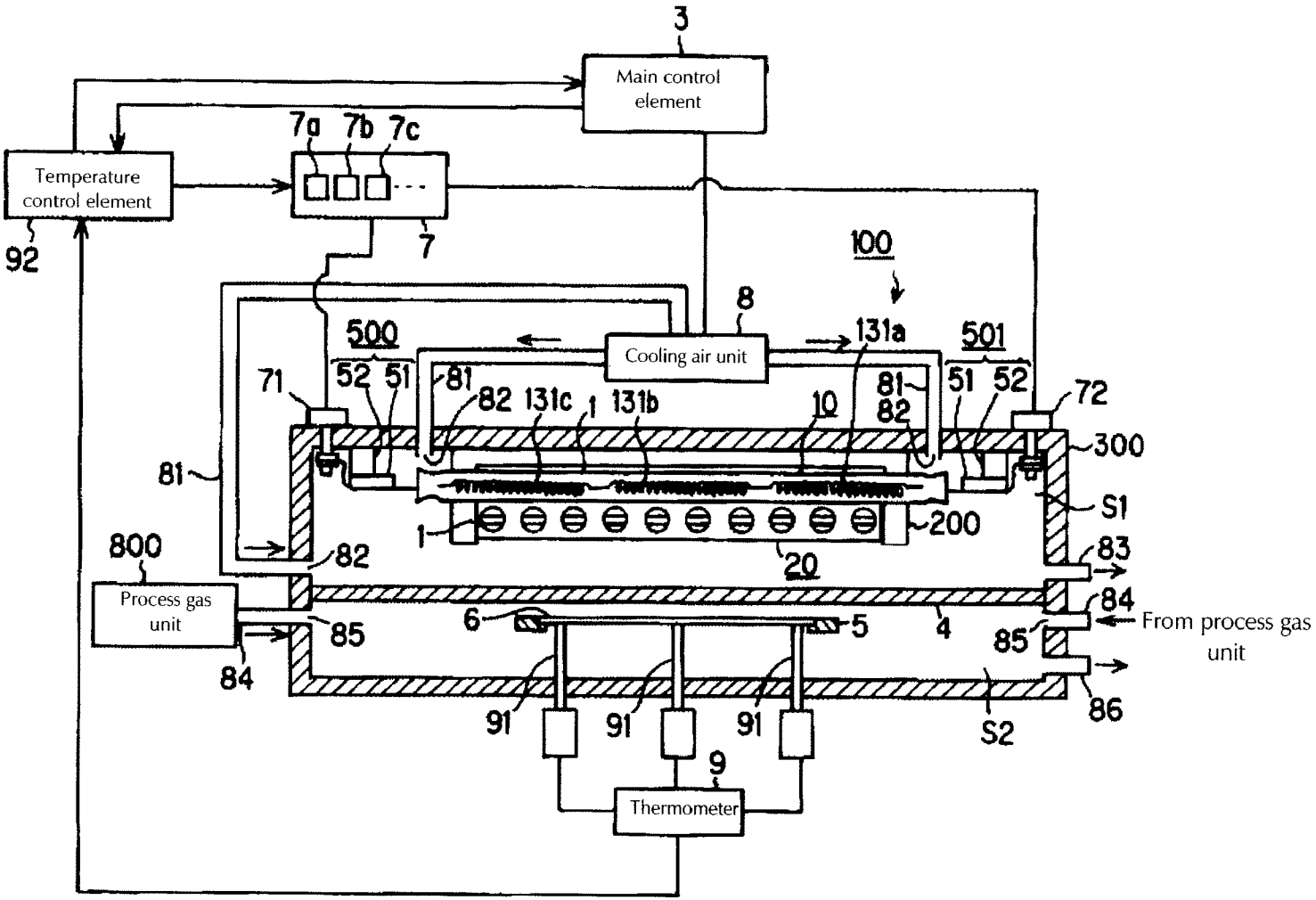
FIG. 4 is a schematic sectional view of the arrangement of one example of a heating device into which filament lamps in accordance with the invention are installed.
Figure 5:
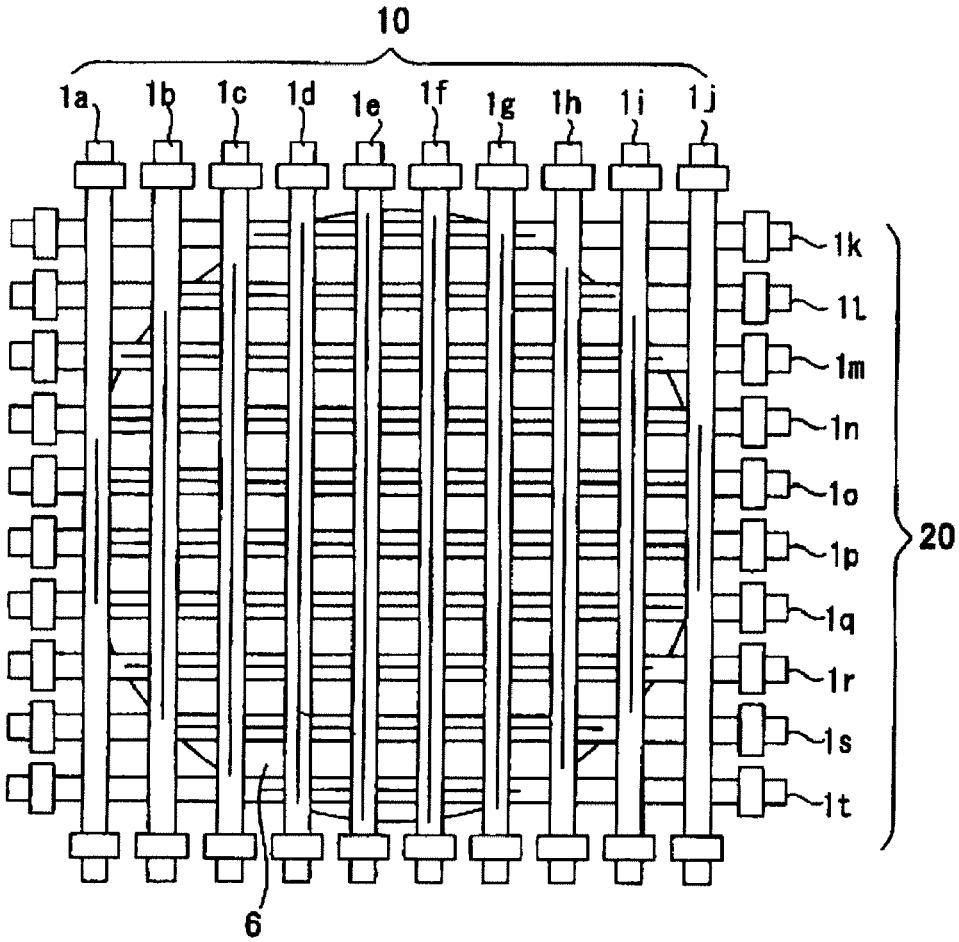
FIG. 5 is a top view of the arrangement of one example of the respective filament lamp in the first lamp unit and the second lamp unit as shown in FIG. 4.
Figure 6:
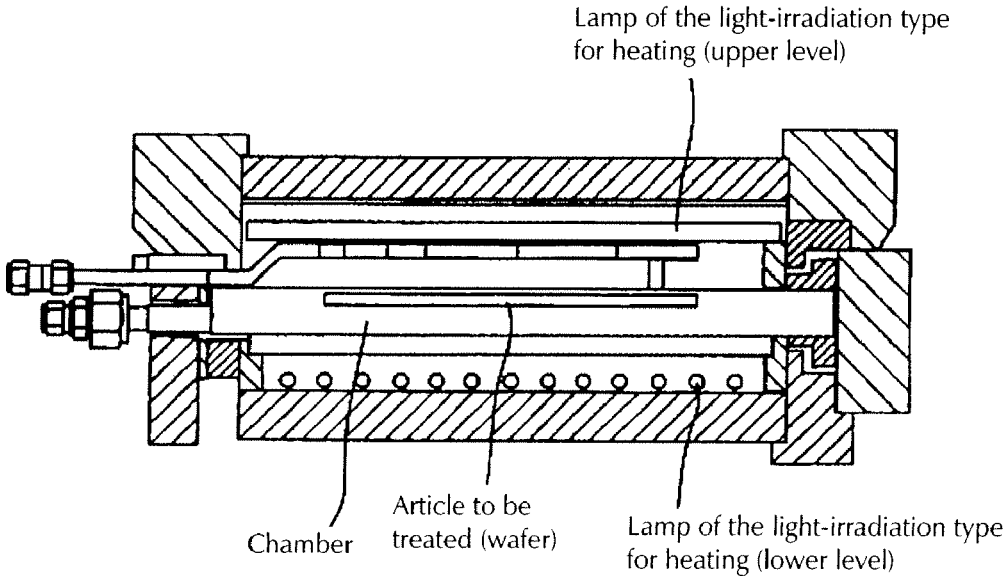
Fig. 6 (Prior Art)
FIG. 6 is a sectional view of a conventional heating device.
Figure 7:
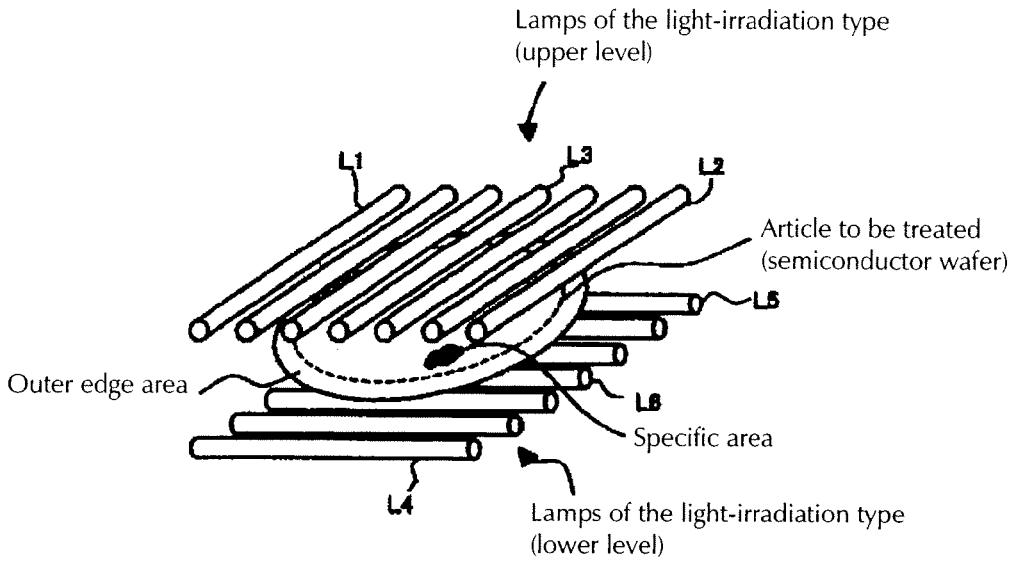
Fig. 7 (Prior Art)
FIG. 7 is a perspective view in which the heating device shown in FIG. 6 is shown simplified, and in which heating filament lamps which are located on the top step and bottom step, and the article to be treated are shown.

FIG. 4 is a cross section of the arrangement of one example of a heating device in which the filament lamp in accordance with the invention is installed. FIG. 5 is a top view of the arrangement of one example of the respective filament lamps of a first lamp unit 10 and a second lamp unit 20 as shown in FIG. 4. In FIG. 4, the heating device 100 has a chamber 300 which is divided by a silica glass window 4 into a lamp unit housing space S1 and a heat treatment space S2. The light emitted from the first lamp unit 10 and the second lamp unit 20 (which are held in the lamp unit housing space S1) passes through the silica glass window 4 onto an article to be treated 6 which is located in the heat treatment space S2. In this way, the article to be treated 6 is heat treated. The first lamp unit 10 and the second lamp unit 20 held in the lamp unit housing space S1 comprises a parallel arrangement of, for example, ten filament lamps 1 at a given distance from one another. The two lamp units 10, 20 are arranged opposite each other with the direction of the center axis of the filament lamps 1 of the lamp unit 10 crossing the direction of the center axis of the filament lamps 1 of the lamp unit 20 as shown in FIG. 5 (such an arrangement is shown per se in the above-mentioned commonly-owned, co-pending U.S. patent application Ser. No. 11/362,788 (Patent Application Publication 2006/0197454 A1). For the lamp units 10, 20, filament lamps 1 with several light emitting parts are arranged parallel to one another with a set spacing. For the filament lamp 1, as was described above, the filaments of the filament bodies are essentially coaxially arranged. By setting the emission of the individual filaments in the filament body or by separate control of power which is supplied to the respective filament body, it becomes possible to set the distribution of the light intensity on the article to be treated 6 at will and moreover with high precision.

Above the first lamp unit 10, there is a reflector 200 which is produced, for example, by coating a base material of low-oxygen copper with gold. The reflection cross section has the shape of part of a circle, part of an ellipse, part of a parabola, a plate shape or the like. The reflector 200 reflects the light emitted upward from the first lamp unit 10 and the second lamp unit 20 onto the side of the article to be treated 6. This means that, in the heating device 100, the light emitted from the first lamp unit 10 and the second lamp unit 20 is emitted directly or by reflection from the reflector 200 on the article to be treated 6.

Cooling air from a cooling air unit 8 is fed into the lamp unit housing space S1 from a blowout opening 82 of the cooling air supply nozzle 81 which is located in the chamber 300. The cooling air delivered into the lamp unit housing space S1 is blown onto the respective filament lamp of the first lamp unit 10 and the second lamp unit 20 and cools the bulb 11 of the respective filament lamp. The hermetically sealed portions of the respective filament lamp 1 have a lower thermal resistance than at the other locations. It is therefore desirable for the blow-out opening 82 of the cooling air supply nozzle 81 to be located opposite the hermetically sealed portions of the respective filament lamp 1 and to preferably cool the hermetically sealed portions of the respective filament lamp 1. The cooling air which is blown onto the respective filament lamp 1 and which has reached a high temperature by heat exchange is released from the cooling air outlet opening 83 located in the chamber 300. The cooling air flows with consideration of the fact that the cooling air which has reached a high temperature by heat exchange does not conversely heat the respective filament lamp 1. For the above described cooling air, the air flow is structured such that the reflector 200 is cooled at the same time. However, in the case in which the reflector 200 is water-cooled by a water cooling device (not shown), the air flow need not be structured such that the reflector 200 is cooled at the same time.

In the silica glass window 4, heat storage occurs due the radiant heat from the article to be treated 6. There are cases in which the heat radiation which is emitted on a secondary basis by the silica glass window 4 which has stored the heat exerts an unwanted thermal effect on the article to be treated 6. In this case, the disadvantages of redundancy of temperature controllability of the article to be treated 6 (for example overshoot, in which the temperature of the article to be treated is higher than the set temperature), of a reduction in temperature uniformity in the article to be treated 6 as a result of temperature scattering of the silica glass window 4 in which heat is stored, and similar disadvantages arise. Furthermore, it becomes difficult to increase the rate of temperature decrease of the article to be treated 6.

To eliminate this disadvantage, it is therefore desirable to arrange the blowout opening 82 of the cooling air supply nozzle 81 as shown in FIG. 4 also in the vicinity of the silica glass window 4 and to cool the silica glass window 4 by the cooling air from the cooling air unit 8.

The respective filament lamp 1 of the first lamp unit 10 is supported by a pair of first fixing frames 500 and 501. The first fixing frames each comprise an electrically conductive frame 51 of an electrically conductive component and of a holding frame 52 which is formed from ceramic or the like. The holding frame 52 is located on the inside wall of the chamber 300 and secures the electrically conductive frame 51. When the number of filament lamps 1 of the above described first lamp unit 10 is n1 and the number of filament bodies of the above described filament lamp 1 is m1 and power is supplied to all filament bodies independently of one another, the combination number of one pair of first fixing frames 500 and 501 is n1×m1. On the other hand, the respective filament lamp 1 of the second lamp unit 20 is supported by the second fixing frames which like the first fixing frames each consist of an electrically conductive frame and a holding frame. When the number of filament lamps 1 of the above described second lamp unit 20 is n2 and the number of filament bodies of the above described filament lamp is m2 and power is supplied to all filament bodies independently of one another, the combination number of one pair of second fixing frames is n2×m2.

In the chamber 300 there is a pair of ports 71, 72 for the main current supply to which the feed lines from the feed devices of the current source part 7 are connected. In FIG. 4 one pair of ports 71, 72 for the main current supply is shown. The number of ports for the main current supply is however fixed according to the number of filament lamps 1, the number of filament bodies within the respective filament lamp, and the like.

In the example as shown in FIG. 4, the port 71 for the main current supply is electrically connected to the electrically conductive frame 51 of the first lamp fixing frame 500. Furthermore, the port 72 for the main current supply is electrically connected to the electrically conductive frame 51 of the first lamp fixing frame 501. The electrically conductive frame 51 of the first lamp fixing frame 500 is electrically connected for example to the outer lead 17*a* (FIG. 1(*a*)). The electrically conductive frame 51 of the first lamp fixing frame 501 is electrically connected for example to the outer lead 17*e* (FIG. 1(*a*)). This arrangement enables supply of the filament 131*b* of one filament lamp 1 for the first lamp unit 10 by the feed device 7*a* for the current source part 7.

The other filament bodies 13*a*, 13*c* of the filament lamp 1, the respective filament of the other filament lamps 1 of the first lamp unit 10 and the respective filament of the respective filament lamp 1 of the second lamp unit 20 are electrically connected in the same way by another pair of ports 71, 72 for the main current supply.

On the other hand, in the heat treatment space S2 there is a treatment frame 5 in which the article to be treated 6 is attached. For example, in the case in which the article to be treated 6 is a semiconductor wafer, the treatment frame 5 is an annular body of a thin plate of metallic material with a high melting point such as molybdenum, tungsten or tantalum, of a ceramic material such as silicon carbide (SiC), or the like, of silica glass or silicon (Si). It is desirable for it to have a protective ring arrangement in which in the inner peripheral region of its circular opening a step area is formed which supports the semiconductor wafer.

The semiconductor wafer which constitutes the article to be treated 6 is arranged such that the semiconductor wafer is installed into the circular opening of the above described annular protective ring and is supported by the above described step area. By radiation the treatment frame 5 heats the outer peripheral edge of the semiconductor wafer which is opposite the frame and in itself also reaches a high temperature due to light radiation, in a supplementary manner. Thus the protective ring equalizes the heat radiation from the outer peripheral edge of the semiconductor wafer. In this way, the temperature drop of the peripheral edge area of the semiconductor wafer as a result of heat radiation and the like from the outer peripheral edge of the semiconductor wafer is suppressed.

On the back of the light irradiation surface of the article to be treated 6 which is located in the treatment frame 5 there is a temperature measurement region 91 bordering or adjacent to the article to be treated 6. The temperature measurement region 91 is used to monitor the temperature distribution of the article to be treated 6. According to the dimensions of the article to be treated 6, the number and the arrangement of the temperature measurement region 91 are fixed. For example, a thermocouple or radiation thermometer is used for the temperature measurement region 91. The temperature information which was monitored by the temperature measurement region 91 is sent to the thermometer 9 which, based on the temperature information sent from the respective temperature measurement region 91, computes the temperature at the measurement points of the respective temperature measurement region 91, and moreover, sends to the main control element 3 the computed temperature information via a temperature control element 92. The main control element 3 based on the temperature information at the respective measurement point on the article to be treated 6 sends a command to the temperature control element 92 so that the temperature becomes uniform on the article to be treated 6 at a given temperature. The temperature control element 92 controls the power which is supplied from the current source part 7 to the filament body of the respective filament lamp 1 based on this command.

In the case, for example, in which the main control element 3 has obtained from the temperature control element 92 the temperature information that the temperature at a measurement point is lower than the stipulated temperature, a command to increase the amount of feed for this filament body is sent to the temperature control element 92 so that the light emitted from the light emitting part of the filament body which is adjacent to this measurement point increases. The temperature measurement element 92 based on the command sent from the main control element 3 increases the power which is supplied to the circuit boards 71, 72 for the main current supply which are connected from the current source part 7 to this filament body.

The main control element 3, during operation of the filament lamp 1 of the lamp units 10, 20, sends to the cooling air unit 8 a command which prevents the bulbs 11 and the silica glass window 4 from shifting into the high temperature state.

Furthermore, depending on the type of heat treatment, a process gas unit 800 is connected to the heat treatment space S2 and delivers or evacuates process gas. In the case for example of carrying out a thermal oxidation process a process gas unit 800 is connected to the heat treatment space S2 and delivers or evacuates oxygen gas and a purge gas (for example, nitrogen gas) for purging the heat treatment space S2. The process gas and the purge gas from the process gas unit 800 are delivered from a blowout opening 85 of a gas supply nozzle 84 located in the chamber 300 into the heat treatment space S2. Evacuation takes place through an outlet opening 86.

The following effects can be obtained by the heating device in accordance with the invention.

As was described above, for lamp units as the light source parts of the heating device in accordance with the invention, in the bulb, several filament bodies in which one filament and leads which supply power to this filament are connected to one another are arranged along the bulb axis and furthermore on the ends of the bulb there are hermetically sealed portions in which several electrically conductive components are located, which are each electrically connected to the above described several filament bodies. Therefore, in this connection, several filament lamps in which the respective filaments can be supplied independently of one another are arranged parallel to one another.

The intensity distribution of the light radiated from the light source parts has conventionally been set by controlling the power supplied to the filament lamps which are located parallel to one another in the light source parts. The above described setting of the light intensity distribution could therefore only be controlled in a direction perpendicular to the axial direction of the bulb.

Since in the filament lamps in accordance with the invention, which are installed in the lamp units as light source parts of the heating device, separate control of the power supplied to the filaments which are located within the bulb in the above described manner is possible, the setting of the above described light intensity distribution can also be controlled in the axial direction of the bulb. It therefore becomes possible to also set the distribution of the irradiance on the surface of the article to be treated in a two-dimensional direction with high precision.

It is possible, for example, even in a narrow defined region with a smaller overall length than the emission length of the filament lamp which was used for the light source part of a conventional heating device, with limitation to this defined region to set the irradiance on this defined region. This means that it becomes possible to set an irradiance distribution which corresponds to the respective characteristic in this defined region and in other regions. It therefore becomes possible to exercise control such that the temperature of the above described defined region and the temperature of the other regions become uniform. Likewise formation of a local temperature distribution in the article to be treated is suppressed and it becomes possible to obtain a uniform temperature distribution over the entire article to be treated.

For example, in the article to be treated 6 which is shown in FIG. 5, there is the case in which the temperature of the region (also called region 1) directly underneath the point at which the filament lamp 1*b* and the filament lamp 1*m* or 1*o* cross, is lower than the temperature of the remaining region (also called region 2) for the article to be treated 6, or the case in which it is found beforehand that the degree of the temperature increase in the region 1 is less than the degree of the temperature increase in the region 2. In this case, by increasing the feed amount for the filament corresponding to the region 1 from the filaments of the filament lamp 1*b*, formation of a temperature distribution between the region 1 and the region 2 can be reliably prevented and a uniform temperature distribution obtained over the entire article to be treated 6. In FIG. 5 the segment shown within the respective filament lamp constitutes the location of the respective filament.

This means that the heating device in accordance with the invention in which the above described several filament lamps are installed makes it possible to precisely set the distribution of the irradiance on the article to be treated which is a given distance away from the lamp units moreover to any distribution. Therefore, it also becomes possible to set the distribution of the irradiance on the article to be treated asymmetrically to the shape of the article to be treated. Thus, even in the case in which the distribution of the degree of the local temperature distribution on the substrate to be heat treated which is the article to be treated is asymmetrical to the substrate shape, it becomes possible to accordingly set the distribution of the illuminance on the article to be treated. As a result, it becomes possible to uniformly heat the article to be treated, for example.

Furthermore, since in the heating device in accordance with the invention filament lamps are used in which the distance between the filaments which are located in the bulb can be made extremely small, the effect of the distance between the non-emitting filaments can be reduced and unwanted scattering of the distribution of the illuminance on the article to be treated can be made extremely small. Since in the vertical direction of the heating device the space for the arrangement of the lamp units formed of several tubular filament lamps should be small, the heating device can be made smaller.

Figure 8:
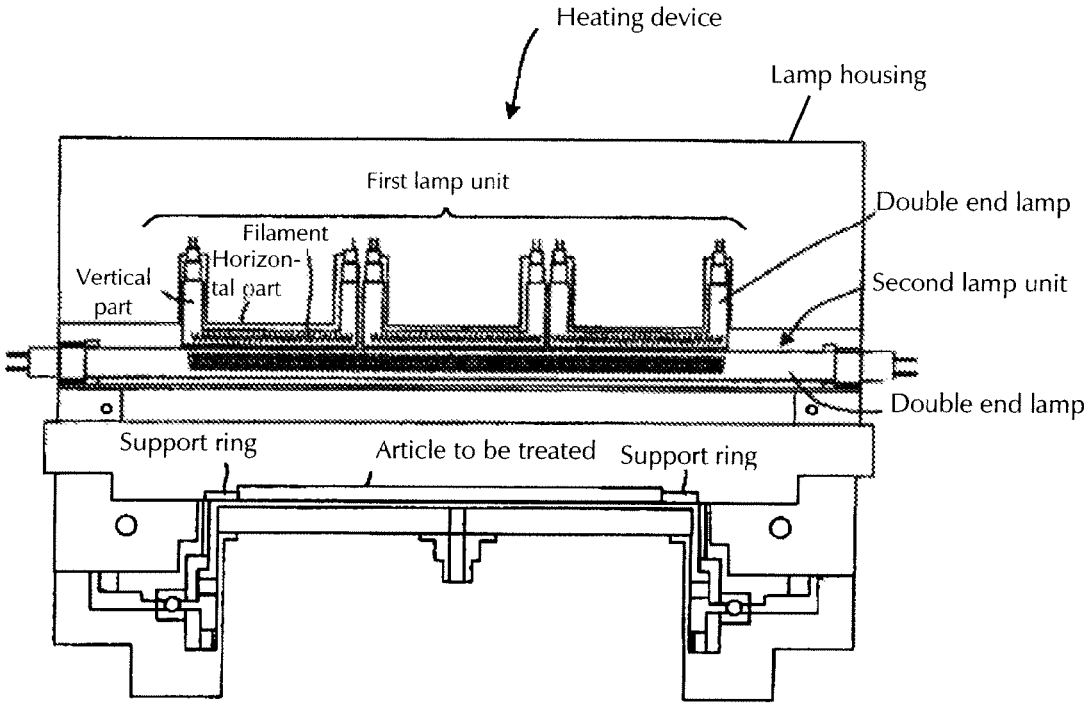
Fig. 8 (Prior Art)
FIG. 8 is a schematic cross-sectional view of a conventional heating device in a front view.

On the other hand, when using the conventional U-shaped lamps shown in FIG. 8, there is the disadvantage that scattering on the article to be treated is great because the boundary area between the horizontal region and the vertical regions has a very great total length and because directly underneath this region no light is emitted. Moreover, the heating device cannot be made smaller because due to the U-shape of the bulb with vertical regions in the vertical direction of the heating device considerable space is required.

Figure 9:
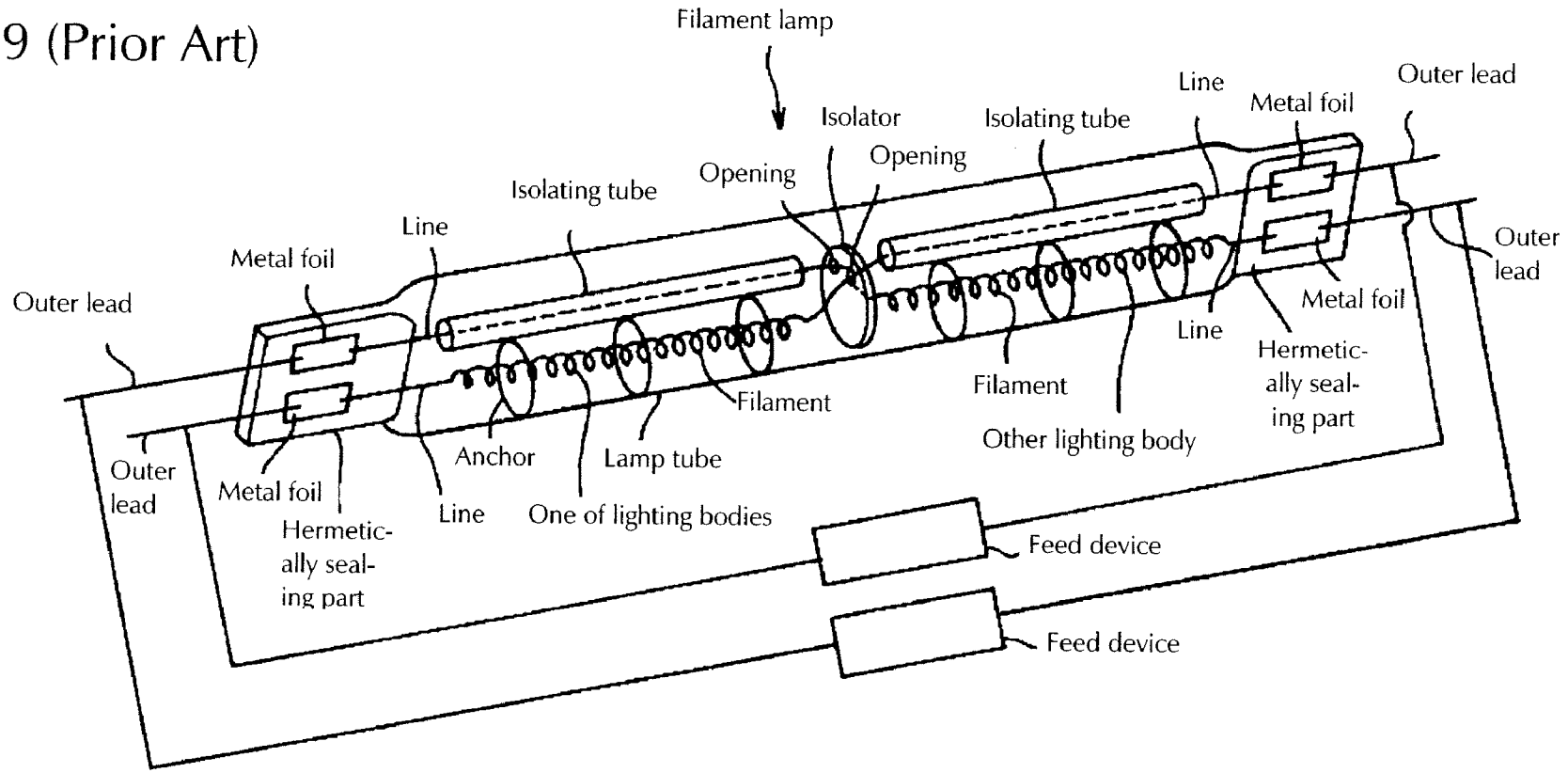
Fig. 9 (Prior Art)
FIG. 9 is a schematic perspective view of a commonly-owned precursor to the filament lamp of the present invention.

In the heating device in accordance with the invention, especially on at least one end of the bulb, there is a rod-shaped insulator for sealing, moreover in the outer periphery of the insulator for sealing there are several metal foils with distances to one another and hermetically sealed portions in which the bulb and the insulator for sealing are hermetically sealed to one another via electrically conductive components in between. Thus, an arrangement of a plurality of metal foils spaced relative to one another on the same periphery is enabled. Furthermore, since the size of all the hermetically sealed portion compared to the case of an arrangement of a plurality of metal foils in a right-angled hermetically sealed portion can be made smaller, as in the filament lamp shown in FIG. 9, a filament lamp with high reliability can be devised without the disadvantages of poor sealing and the like occurring.

What is claimed is:

1. Filament lamp, comprising:

a bulb, on at least one end of which there is a hermetically sealed portion;

a plurality of filament bodies having filaments and leads for supply of power to the filaments connected to one another, a plurality of electrically conductive components, each of which is electrically connected to a respective one of the filament bodies, wherein a solid rod-shaped sealing insulator is located in the hermetically sealed portion, wherein the electrically conductive components are arranged on the periphery of the sealing insulator at a distance from one another, and wherein the electrically conductive components are sealed between the hermetically sealed portion of the bulb and the sealing insulator.

2. Filament lamp in accordance with claim 1, wherein the electrically conductive components comprise at least metal foils which are electrically connected to the filament bodies, wherein outer leads are electrically connected to the metal foils, and wherein positioning openings for the outer leads are formed in the sealing insulator.

3. Filament lamp in accordance with claim 1, wherein a tapering area is formed on at least one end of the sealing insulator.

4. Filament lamp in accordance with claim 1, wherein the bulb has two opposite ends, each having a hermetically sealed portion and a rod-shaped sealing insulator located therein, with the several electrically conductive components being arranged spaced relative to one another in the outside peripheries of each of the insulators.

5. Filament lamp in accordance with claim 4, wherein the filament bodies are located along an axis of the bulb.

6. Filament lamp in accordance with claim 1, wherein the filament bodies are located along an axis of the bulb.

* * * * *